US010866049B2

(12) United States Patent
Werner

(10) Patent No.: US 10,866,049 B2
(45) Date of Patent: Dec. 15, 2020

(54) REMOTE CONTROLLED SAFETY CATCH OR FIRE-MODE SELECTOR FOR DISABLEMENT OF ONE OR MORE FIREARMS AT LIVE FIRE-RANGES AND RELATED METHODS

(71) Applicant: Aaron Werner, Phippsburg, CO (US)

(72) Inventor: Aaron Werner, Phippsburg, CO (US)

( * ) Notice: Subject to any disclaimer, the term of this patent is extended or adjusted under 35 U.S.C. 154(b) by 0 days.

(21) Appl. No.: 16/231,856

(22) Filed: Dec. 24, 2018

(65) Prior Publication Data

US 2019/0301826 A1 Oct. 3, 2019

Related U.S. Application Data

(60) Provisional application No. 62/610,220, filed on Dec. 24, 2017.

(51) Int. Cl.
*F41A 19/08* (2006.01)
*F41A 19/33* (2006.01)
*F41A 19/59* (2006.01)

(52) U.S. Cl.
CPC ..... *F41A 19/08* (2013.01); *F41A 19/33* (2013.01); *F41A 19/59* (2013.01)

(58) Field of Classification Search
CPC ..... F41A 19/08; F41A 19/33; F41A 19/59; F41A 17/00; F41A 17/46; F41A 17/02; F41A 17/40
USPC ..... 89/132, 135, 136, 142, 148, 27.12; 42/70.01
See application file for complete search history.

(56) References Cited

U.S. PATENT DOCUMENTS 2,948,192 A * 8/1960 Evans ..... F41A 19/59 89/28.05
4,867,039 A * 9/1989 Dobbins ..... F41A 9/35 89/127
7,089,844 B2 * 8/2006 Becker ..... F41A 7/06 89/9
8,756,847 B2 * 6/2014 Huther ..... F41A 17/74 42/70.01
9,557,128 B2 * 1/2017 Miller, III ..... F41A 17/46
2007/0180984 A1 * 8/2007 Huther ..... F41A 17/74 89/148
2008/0302235 A1 * 12/2008 Lauck ..... F41A 17/46 89/132
2013/0111794 A1 * 5/2013 Dionne ..... F41A 17/00 42/70.01
2013/0111795 A1 * 5/2013 Dionne ..... F41A 17/00 42/70.11
2013/0111796 A1 * 5/2013 Dionne ..... F41A 17/00 42/70.11
2014/0366419 A1 * 12/2014 Allan ..... F41A 17/06 42/70.06
2016/0025438 A1 * 1/2016 Alderman ..... G01S 19/14 42/70.11
2016/0091268 A1 * 3/2016 Miller, III ..... F41A 17/46 42/70.06
2016/0348994 A1 * 12/2016 Allan ..... F41A 17/46
2019/0301826 A1 * 10/2019 Werner ..... F41A 19/08

* cited by examiner

*Primary Examiner* — Samir Abdosh
(74) *Attorney, Agent, or Firm* — Buche & Associates, P.C.; John K. Buche; Bryce A. Johnson

(57) ABSTRACT

Disclosed are remote controlled safety catch or fire-mode selectors for disablement of one or more firearms at live fire-ranges and related methods.

7 Claims, 12 Drawing Sheets

REMOTE CONTROLLED SAFETY CATCH OR FIRE-MODE SELECTOR FOR DISABLEMENT OF ONE OR MORE FIREARMS AT LIVE FIRE-RANGES AND RELATED METHODS

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The subject matter of this disclosure is in the field of remote controlled safety catches or fire-mode selectors and related methods of use. The subject matter of this disclosure is also in the field of apparatus and related methods of training military, law-enforcement, or civilian firearm shooters at live-fire ranges.

Background of the Invention

Firearms are typically barreled apparatuses for launching one or more projectiles toward a target via rapidly expanding gasses initiated by an explosive. Firearms have many applications which include civilian, law enforcement, and military uses. Regardless of the application, improper or accidental firearm use or accidental firearm discharge can result in unintended injury to persons or property. As a result: (a) firearm users are usually required to receive firearm training and practice prior to unsupervised firearm use; and (b) firearms are outfitted with safety catches (also known as trigger locks) or fire mode selectors to prevent accidental discharge.

Firearm training is frequently undertaken at live firing ranges (also known as shooting ranges), or specialized facilities designed for firearms practice. Generally, firing ranges are defined by at least one firing point or firing line (or area for firearm discharge) that is separated from a back-stopped target by an empty or unoccupied field. Firing ranges are typically overseen by a range master or range safety officer who is responsible for ensuring that all firearm safety rules are followed at the range. One safety rule may be that all firearms on the range be trigger-locked prior to entering or leaving the firing point. Furthermore, emergency situations arise where a shooting point or firing line is required to be "cold" (i.e., a situation where no firearm discharge is permitted). Yet still, sometimes a live shooting point or line may have a "cease fire" situation. Therefore, a need exists for apparatus and related methods of ensuring that firearms on a firing range are trigger-locked whenever shooters are outside the firing point/line, the range is cold, or a cease fire is initiated.

Problems can arise at a firing range in view of a single range master. For instance, a single range master is limited in his or her ability to see every safety violation or initiate a cease fire when out of view or hearing of a shooting line. These problems are particularly relevant in military applications such as Foreign Internal Defense (FID) missions. Thus, a need exists for apparatus and related methods for allowing non range masters to prevent safety violations or initiate a cease fire.

Many firing ranges offer firearm training courses wherein Instruction is offered to shooters while multiple shooters are moving and shooting within the shooting point or firing line of the range. Sometimes, courses are offered by different instructors to different classes at the same time in the firing line. Other times, for instance in FID missions, instruction is offered by instructors that speak a different language than the students in the course. Multiple classes in the same firing line or language barriers can cause confusion about firing times so that, as a result, safety issues arise. Thus, a need also exists for apparatus and related methods for instructors of courses to enable or disable firearm discharge of their students regardless of language barriers or when multiple courses or shooting groups are in close proximity to one another at a single firing range.

Safety catches or fire mode selectors are almost universal to firearms. Sometimes, automatic or remote controlled safety catches or mode selectors are employed in firearms, most notably to prevent a non-owner of the firearm from discharging the firearm. Although not taught in the art, remote controlled or automatic safety catches could be employed to quickly disable firearm use for a group of shooters at a firing range (e.g., during a cease fire). However, many of the known remote controlled safety catches or mode selectors disable the firearm so that, if the remote control fails or breaks, the gun cannot be fired until either the remote control or its battery replaced. Hence, a need remains for an apparatus and related methods of enabling or disabling firearm discharge wherein the apparatus can be bypassed when the same is not operating correctly.

SUMMARY OF THE INVENTION

In view of the foregoing, it is an object of the present disclosure to describe apparatus and related methods for remote actuation of a safety or fire mode selector of a firearm. In particular, it is an object to describe said apparatus and related methods for use in connection with firearm training or instruction at live firing ranges. In one embodiment, the apparatus is defined by a wireless (e.g., radio frequency or other wireless communication signal) remote and a remote-controlled safety or mode selector system that is assembled to the lower receiver and pistol grip of a firearm (e.g., a rifle such as an M4, M16 and AR15 platform).

In a preferred embodiment, a firearm may suitably be retrofit with: (1) a safety selector lever that features a nub disposed at the tip of the lever's control rod so that a selector drive gear may be installed on the nub to impart motion from the selector drive gear to the safety selector lever; and (2) a remote controlled drive system in the handle that is mechanically coupled to the selector drive gear so that the drive system can be remotely controlled to impart motion from the drive system to the drive gear whereby the safety selector lever may be manipulated from, e.g., a "fire" position to a "safe" position. Suitably, the safety or mode selector may be provided with a receiver for receiving mode selection commands from the remote control. In one embodiment, the mode selection commands may be "Lock" or "Unlock." In use, firing range safety personnel or weapons instructors may maintain a remote control for shooters with the remote controlled safety or mode selector installed on their firearms so that firearms at a firing range may be selectively locked or unlocked by the instructors or safety personnel. In a preferred embodiment, the mode selector may be turned from a lock or safe position to a fire position by the shooter.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which.

In the figures, the following components and corresponding reference numerals are referred to in the drawings.

1000—fire arm;
1100—buttstock;
1200—charging handle;
1300—rear sight;
1400—lower receiver;
  1410—safety selector lever;
    1411—control lever;
    1412—control rod;
    1413—nub;
    1414—control rod receiver;
    1415—safety detent spring;
    1416—safety detent;
  1420—trigger;
1500—pistol grip;
  1510—lock washer;
  1520—pistol grip screw;
  1530—selector drive gear;
    1531—nub receiver;
    1532—gear line receiver;
    1533—gear line track;
    1535—gear line;
  1540—pistol grip drive gear;
    1541—spindle receiver;
    1542—gear line receiver;
    1543—gear line track;
    1544—gear teeth;

1550—drive;
1551—drive rod;
1552—drive threads;
1560—pistol grip plate;
1561—electrical pathway;
1562—spindle;
1563—motor receptacle;
1570—motor;
1580—mother board;
1581—battery;
1582—charging port;
1590—right-side grip casing;
1595—left-side grip casing;
1600—magazine;
1700—hand guard;
1800—front sight; and
1900—barrel.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed may be an improvement to safety control levers and related systems for remotely controlling the safety control lever. In one embodiment, the system may be defined by a wireless (e.g., radio frequency or other wireless communication signal) remote and a remote-controlled safety or mode selector system that is assembled to the lower receiver and pistol grip of a firearm (e.g., a rifle such as an M4, M16 and AR15 platform). The more specific details of the system are described with reference to the drawings.

Figure 1A:
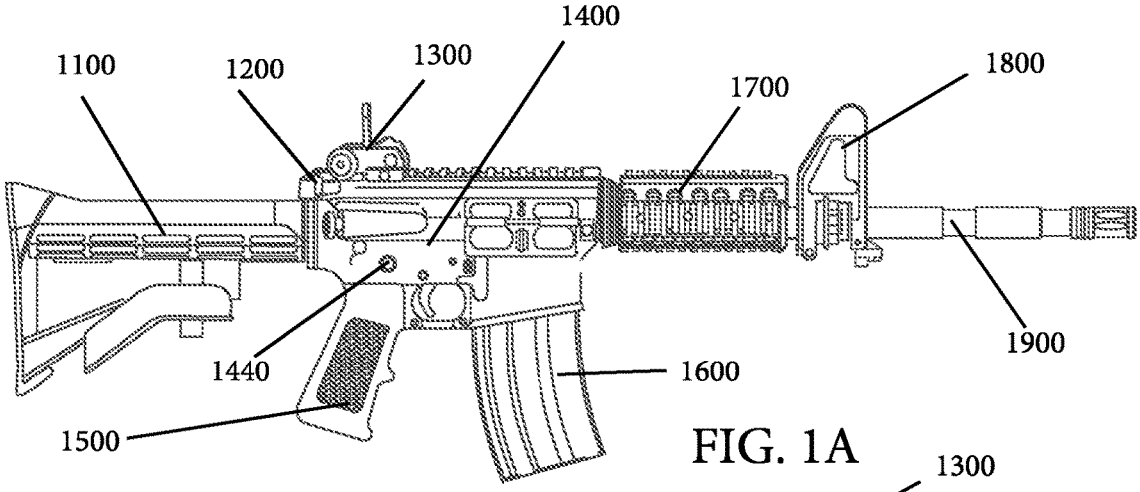
FIG. 1A is a right-side view of a firearm 1000.
Figure 1B:
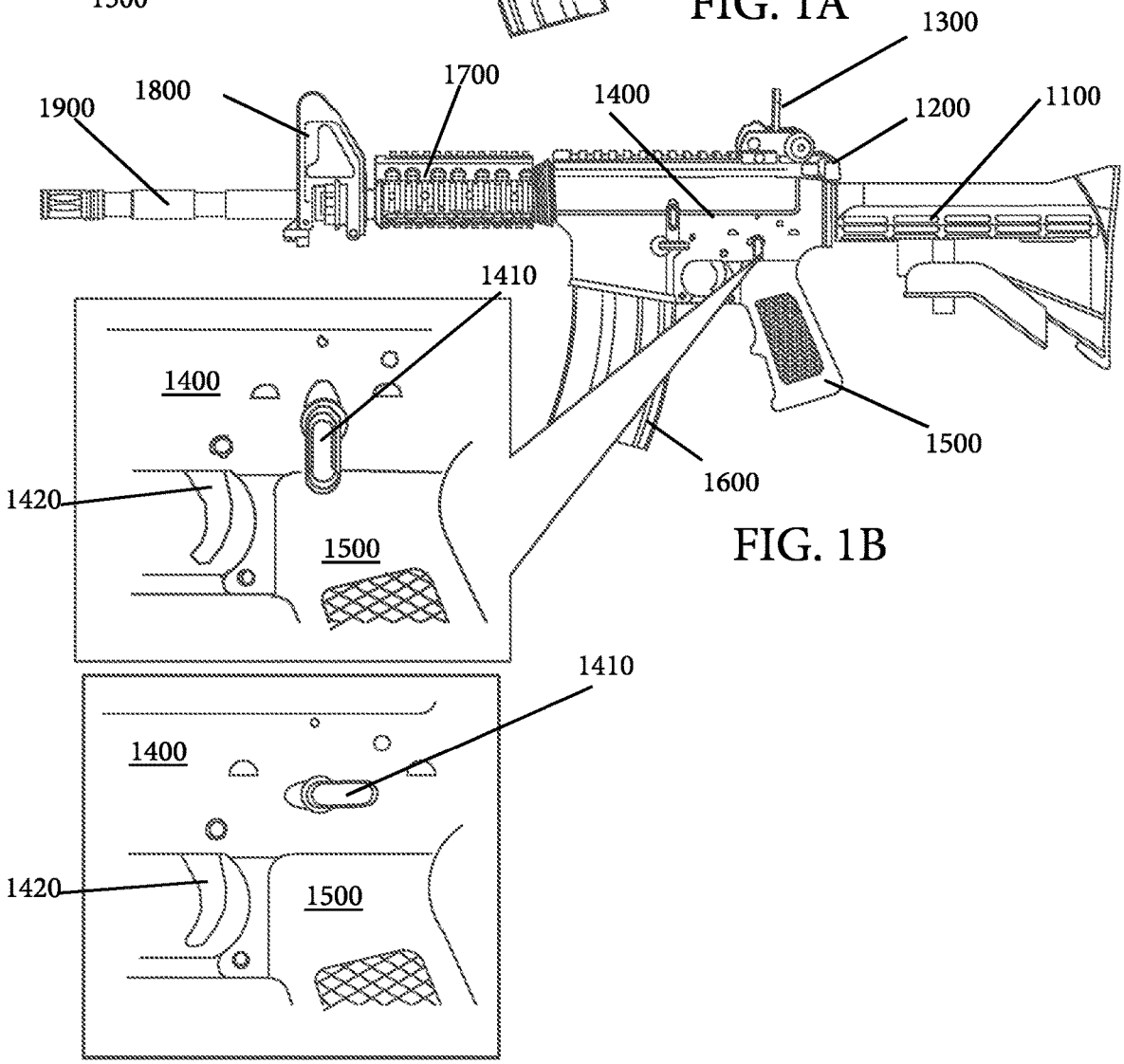
FIG. 1B is a left-side view of the firearm 1000 with two (2) zoom-in views of alternate configurations of relevant parts of the lower receiver 1400 and pistol grip 1500 of the fire arm 1000.

FIG. 1A is a right-side view of a firearm 1000. The firearm 1000 is typical and consists of a buttstock 1100, a charging handle 1200, a rear sight 1300, a lower receiver 1400, a pistol grip 1500, a magazine 1600, a hand guard 1700, a front sight 1800, and a barrel 1900. FIG. 1B is a left-side view of the firearm 1000 with two (2) zoom-in views of alternate configurations of relevant parts of the lower receiver 1400 and pistol grip 1500 of the fire arm 1000. Specifically, the zoom-in views of FIG. 1B show a safety selector lever 1410 in a "FIRE" position (top) and a "SAFE" position (bottom).

Still referring to FIGS. 1A and 1B, the safety selector lever 1410 is positioned adjacent to the trigger 1200 and through the lower receiver 1400 of the fire arm 1000 so that it may be operated via the thumb of a gunman's trigger hand while gripping the pistol grip 1500. In operation, the safety selector lever 1410 may be switched from "FIRE" and "SAFE" positions via manual rotation from a downward position (top) to a lateral position (bottom). Alternatively, the safety selector lever 1410 may be switched between "SAFE" and "FIRE" positions via manual rotation from a lateral position (bottom) to a downward position (top).

Figure 2A:
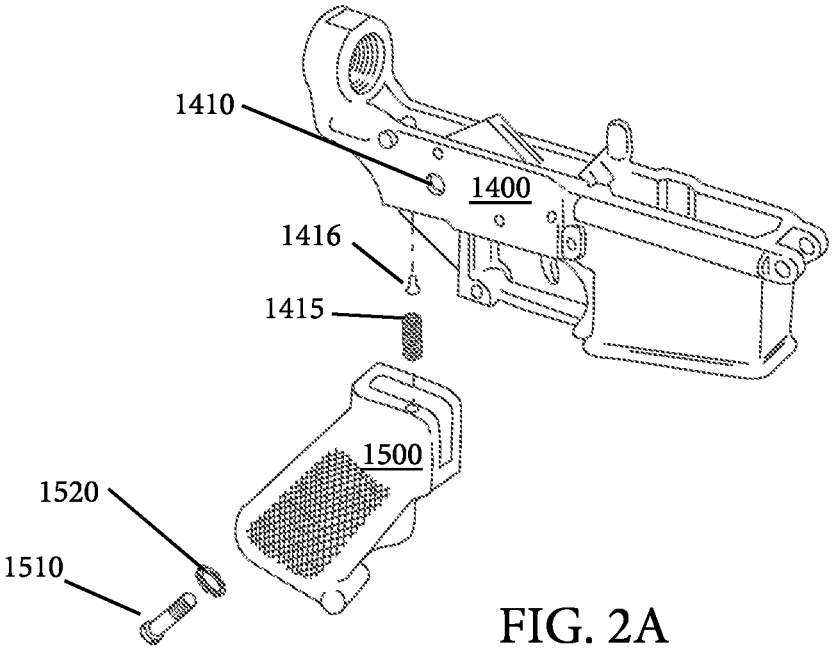
FIG. 2A is a top-oriented and exploded prospective view of the right-side of a lower receiver 1400 and pistol grip 1500 of a firearm 1000.
Figure 2B:
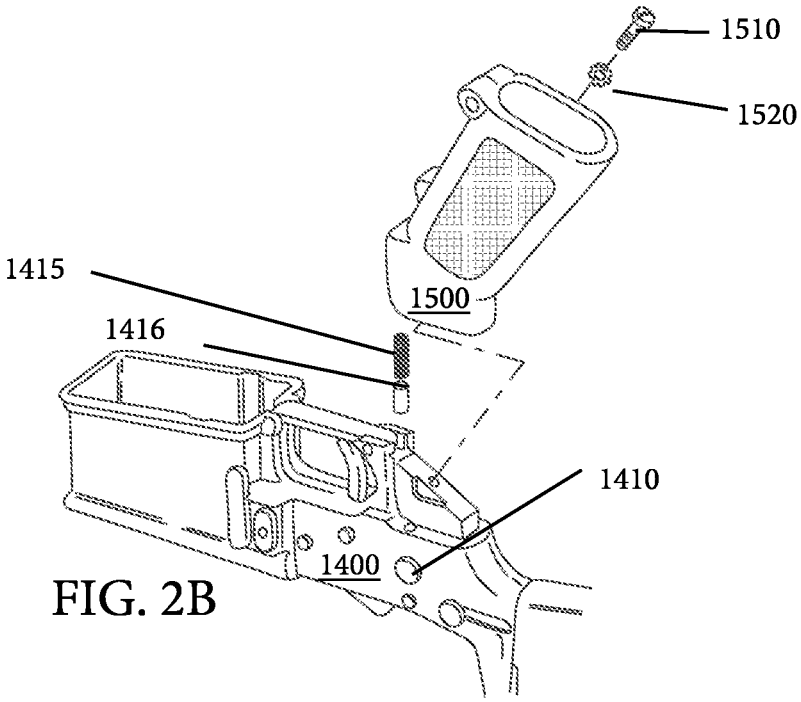
FIG. 2B is a is a bottom-oriented and exploded perspective view of the right-side of a lower receiver 1400 and pistol grip 1500 of a firearm 1000.

As set forth above, the safety selector lever 1410 is installed through the lower receiver 1400 and operated manually from the pistol grip 1500. FIG. 2A is a top-oriented and exploded prospective view of the right-side of a lower receiver 1400 and pistol grip 1500 of a firearm 1000. FIG. 2B is a bottom-oriented and exploded perspective view of the right-side of a lower receiver 1400 and pistol grip 1500 of the same firearm 1000 of FIG. 2A. Referring to FIGS. 2A and 2B, the pistol grip 1500 and lower receiver 1400 are coupled via a pistol grip screw 1510 through the butt of the pistol grip 1500 that fastens the grip 1500 to the receiver 1400. In some instances, a lock washer 1520 may be included with the pistol grip screw 1510 to reduce the risk that the fastening of the grip 1500 to the receiver 1400 unexpectedly fails. Additionally, a safety detent 1416 and safety detent spring may be installed or uninstalled via removal of the grip 1500. The safety detent 1416 operates via applying spring pressure to the safety selector lever 1410 so that it cannot be too easily or unintentionally rotated between FIRE and SAFE positions (see, e.g., FIG. 1B).

Figure 3A:
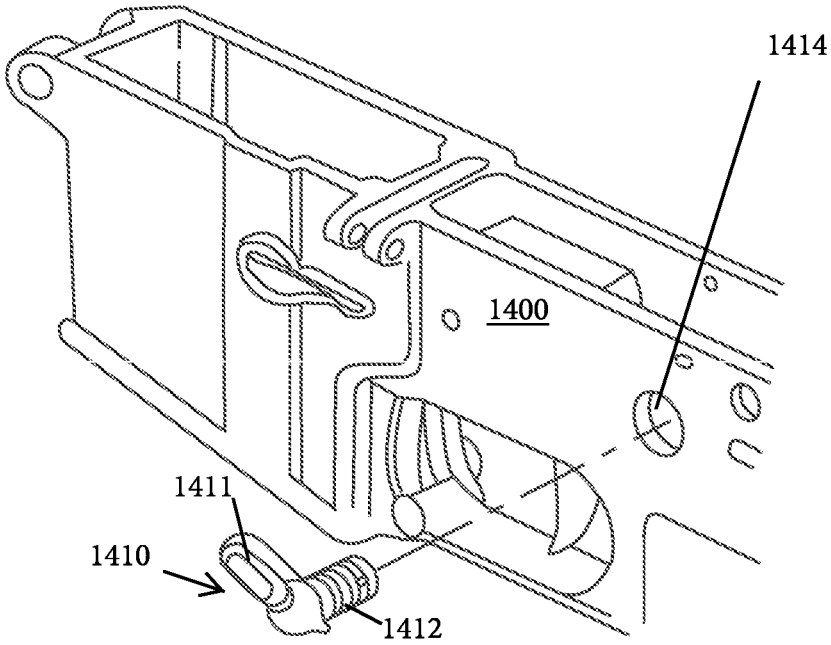
FIG. 3A is a top-oriented and exploded perspective view of the left side of the lower receiver 1400 and safety selector lever 1410.
Figure 3B:
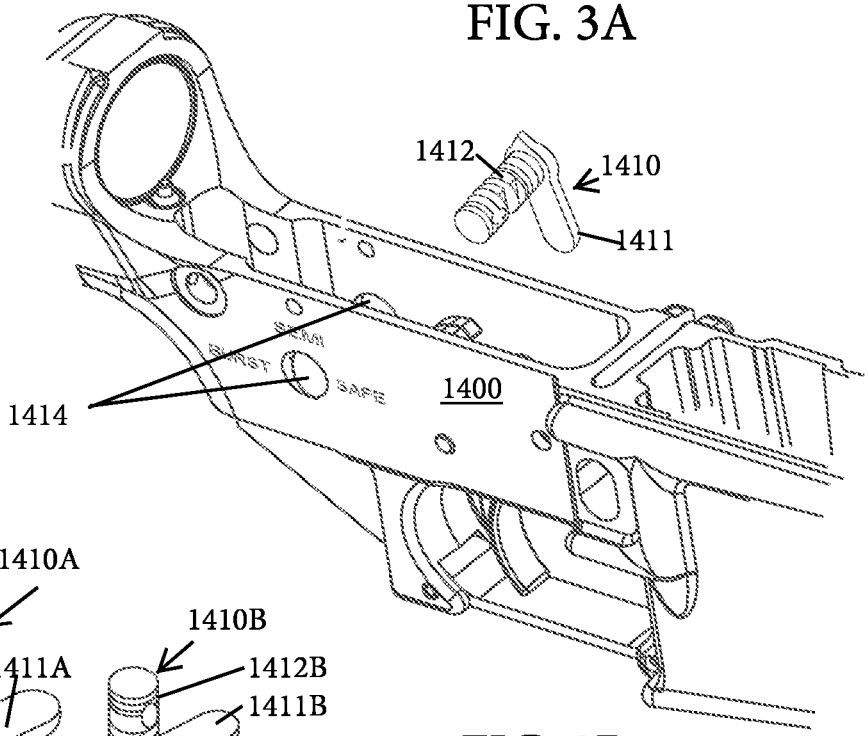
FIG. 3B is a top-oriented and exploded perspective view of the right side of the lower receiver 1400 and the safety selector lever 1410.
Figure 4:
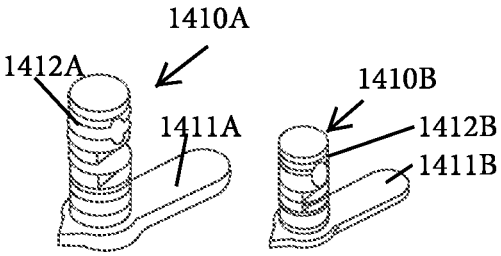
FIG. 4 is a side-by-side perspective view of alternate embodiments of safety selector levers 1410A, 1410B.

As discussed above, a typical safety selector lever 1410 is operated via manual rotation of the lever 1410 within the lower receiver 1400. FIG. 3A is a top-oriented and exploded perspective view of the left side of the lower receiver 1400 and safety selector lever 1410. FIG. 3B is a top-oriented and exploded perspective view of the right side of the lower receiver 1400 and the safety selector lever 1410. Referring to FIGS. 3A and 3B a typical safety selector lever is defined by a control lever 1411 and a control rod 1412. Suitably, the control rod traditionally is pivotally passed through a control rod receiver 1414 of the lower receiver 1400. As shown in FIG. 4, the safety control lever 1410 can be customized relative to a particular firearm via longer or shorter control rods and levers (e.g., 1410A-1412A versus 1410B-1412B). In use, the safety selector lever is rotated around the control rod 1412 within the control rod receiver 1414 via thumb interaction with the lever 1411. Suitably, the rod 1412 features various grooves or other embellishments so that the detent 1416 (FIGS. 2A & 2B) may be applied to restrict easy movement of the safety control lever 1410 between FIRE and SAFE Positions. Suitably, the face of the control rod 1412 is visible on the opposite side of the receiver 1400 as the lever 1411 when installed.

Figure 6:
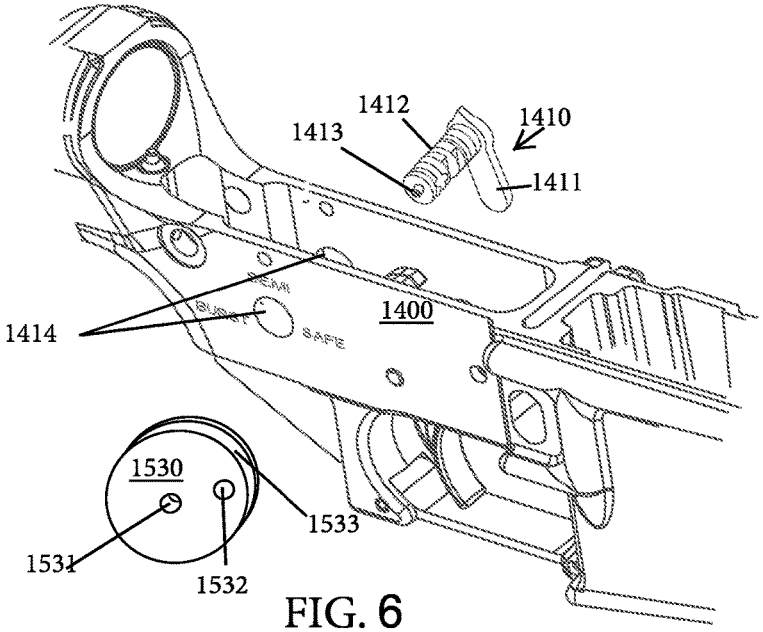
FIG. 6 is a top-oriented and exploded perspective view of the right side of the lower receiver 1400, the improved safety selector lever 1410, and the selector drive gear 1530.
Figure 5:
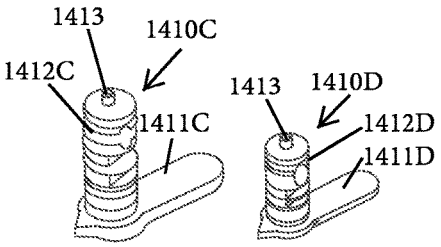
FIG. 5 is a side-by-side perspective view of alternate embodiments of improved safety selector levers 1410C, 1410D.

FIG. 5 is a side-by-side perspective view of alternate embodiments of improved safety selector levers 1410C, 1410D. As shown, the safety selector levers 1410C, 1410D feature a nub 1413C, 1413D on the face of the rod 1412C, 1412D. FIG. 6 is a top-oriented and exploded perspective view of the right side of the lower receiver 1400, the improved safety selector lever 1410, and the selector drive gear 1530. As shown, the nub 1413C, 1413D is configured such that the nub is exposed on the opposite side of the receiver 1414 when installed. Preferably, the nub 1413C, 1413D defines an attachment mechanism for securing the face of the control rod 1412C, 1412D to a selector drive gear 1530. As shown, the selector drive gear 1530 is suitably defined by a disc with a nub receiver 1531, a gear line receiver 1532, and a gear line track 1533 (around the sidewall of the disk). Preferably, the nub 1413C, 1413D and the nub receiver 1531 may interact (e.g., via weld, restriction fit, or other attachment mechanism) to mechanically fix the selector drive gear 1530 to the control rod 1412 of the safety selector lever 1410. Preferably, the mechanical fixation between the selector drive gear 1530 to the control rod 1412 results in the gear 1530 rotating whenever the lever 1410 is rotated and vice versa.

Figure 7:
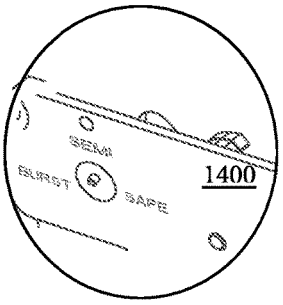
FIG. 7 is a schematic of mechanical correspondence of movement between the selector drive gear 1530 and the control lever 1411.
Figure 7:
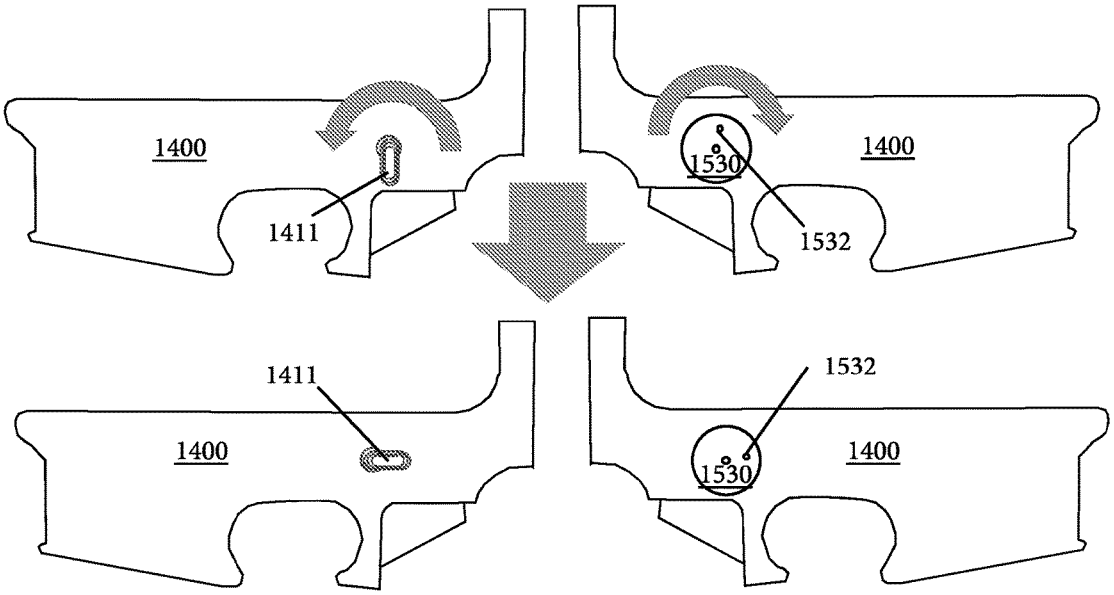

FIG. 7 is a schematic of mechanical correspondence of movement between the selector drive gear 1530 and the control lever 1411. The figure shows a lever 1411 and gear 1530 superimposed over a generic lower receiver 1400. As shown in the top-to-bottom progression diagram, clockwise rotation of the gear 1530 results in counterclockwise rotation of the lever 1411.

Figure 8:
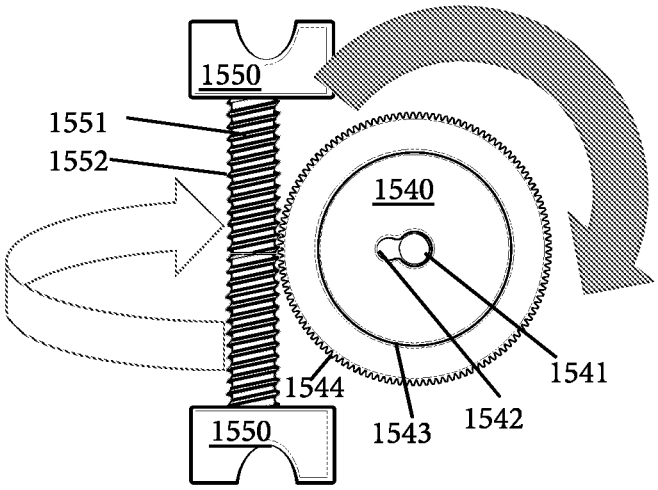
FIG. 8 is a schematic of mechanical correspondence of movement between a driver 1550 and a pistol grip drive gear 1540.

One objective of this disclosure is to describe a remote controlled drive system that is mechanically coupled to the selector drive gear 1530 so that the drive system can be remotely controlled to impart motion from the drive system to the drive gear 1530 whereby the safety selector lever 1411 may be manipulated from, e.g., a "fire" position to a "safe" position. In the preferred embodiment, the disclosed drive system features a rotatable pistol grip drive gear 1540 that can be turned via a motorized driver 1550 so that the pistol grip drive gear 1540 correspondingly turns the lever drive gear 1530 (see, e.g., FIG. 7). FIG. 8 is a schematic of mechanical correspondence of movement between a driver 1550 and a pistol grip drive gear 1540. In a preferred embodiment, a motor 1570 (not shown) may be installed on the driver 1550 to turn threaded 1552 drive rod 1551 so that the threads 1552 of the drive rod 1551 interact with teeth 1544 of the pistol grip drive gear 1540 to cause rotation. As discussed below, the drive gear 1540 and the drive rod 1551 may be installed in the grip 1500 and tied to the lever gear 1530.

Figure 9A:
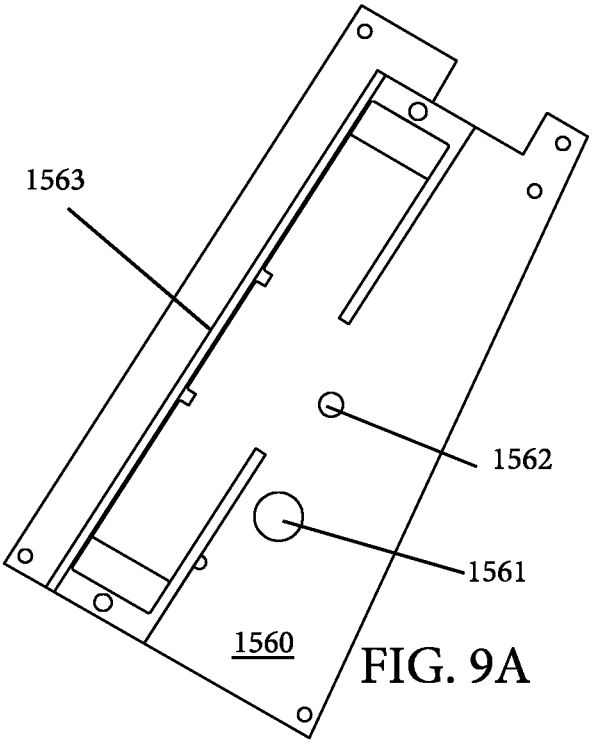
FIG. 9A is a front view of a pistol grip plate 1560.
Figure 9B:
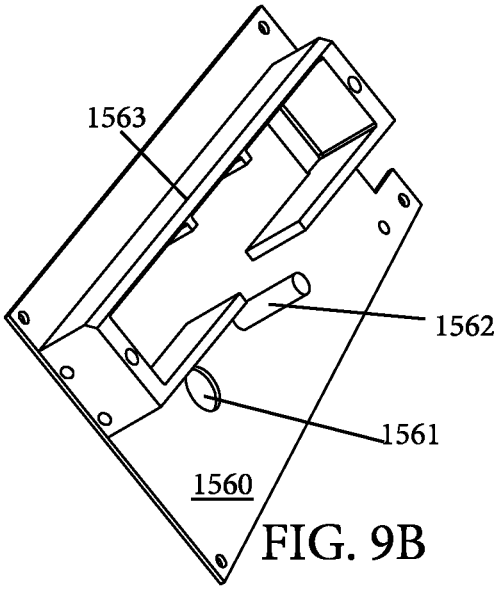
FIG. 9B is a bottom-oriented perspective view of the pistol grip plate 1560.
Figure 9C:
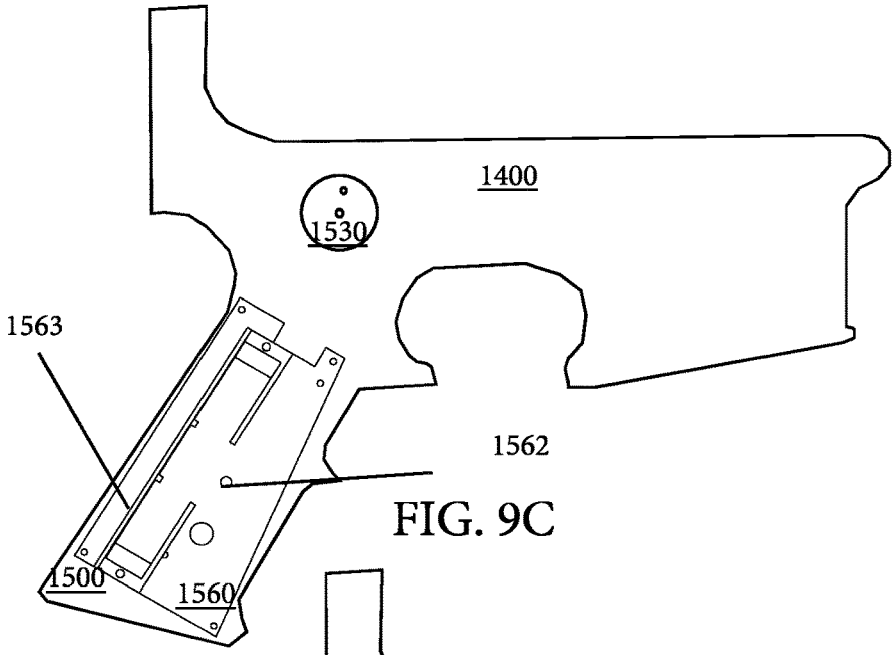
FIG. 9C is a right-side diagram of the pistol grip plate 1560 and selector drive gear 1530 overlade on a silhouette of the lower receiver 1400 and pistol grip 1500 of a firearm 1000.
Figure 9D:
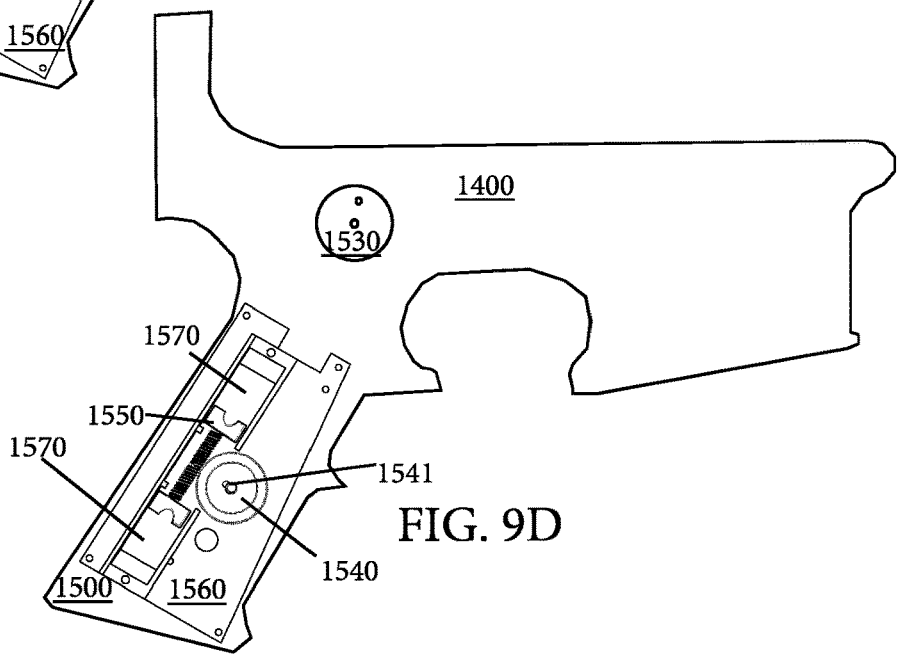
FIG. 9D is a right-side diagram of the pistol grip plate 1560 and selector drive gear 1530 overlade on a silhouette of the lower receiver 1400 and pistol grip 1500 of a firearm 1000 with the pistol grip drive gear 1540, motor 1570, and driver 1580.
Figure 9E:
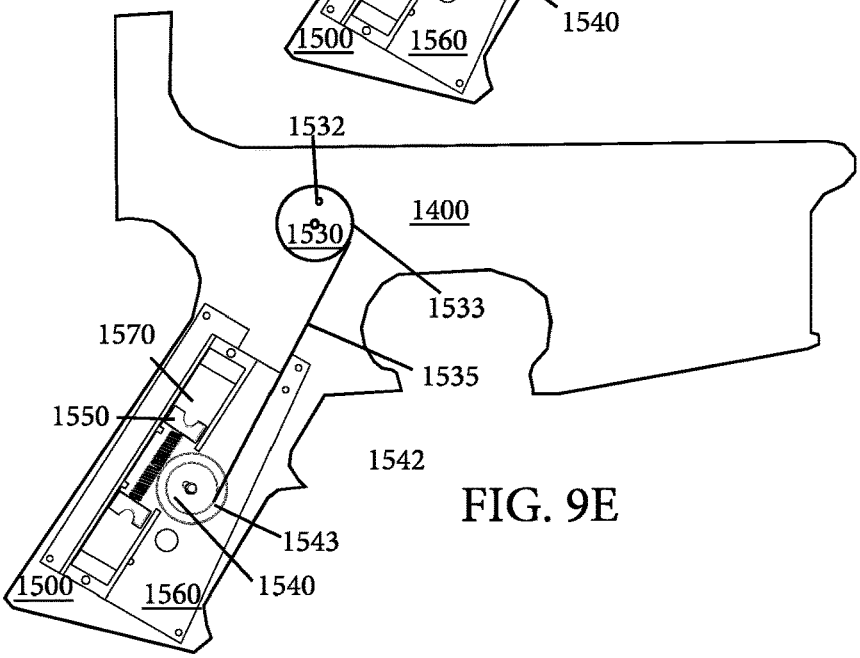
FIG. 9E is a right-side diagram of the gear line 1530 tying the lever gear 1530 to the grip gear 1540.

FIG. 9A is a front view of a pistol grip plate 1560. FIG. 9B is a bottom-oriented perspective view of the pistol grip plate 1560. The pistol grip plate operates to retain the drive system in the pistol grip 1500 (not shown). Suitably, the plate 1560 is defined by a flat plate with a electrical pathway defined by a hole through the plate, a spindle 1562 positioned outwardly from the plate, and a motor receptacle 1563. FIG. 9C is a right-side diagram of the pistol grip plate 1560 and selector drive gear 1530 overlade on a silhouette of the lower receiver 1400 and pistol grip 1500 of a firearm 1000. As shown in the figure, the drive system is not yet installed. FIG. 9D is a right-side diagram of the pistol grip plate 1560 and selector drive gear 1530 overlade on a silhouette of the lower receiver 1400 and pistol grip 1500 of a firearm 1000 with the pistol grip drive gear 1540, motor 1570, and driver 1580. As shown in FIGS. 9C and 9D, the driver 1550 may be coupled to one or more motors 1570 configured to turn the drive rod 1551. The motors and driver 1550 may be disposed in the receptacle 1563 so that the threads of the drive rod 1551 cooperate with the teeth 1554 of the grip gear 1540. FIG. 9E is a right-side diagram of the gear line 1535 tying the lever gear 1530 to the grip gear 1540. Suitably, the gear line 1535 resides in the tracks 1543, 1533 and is secured to the gears via the receivers 1532, 1542. In one mode of operation the gear line 1535 transfers rotating motion between the gears 1530, 1540.

Figure 10:
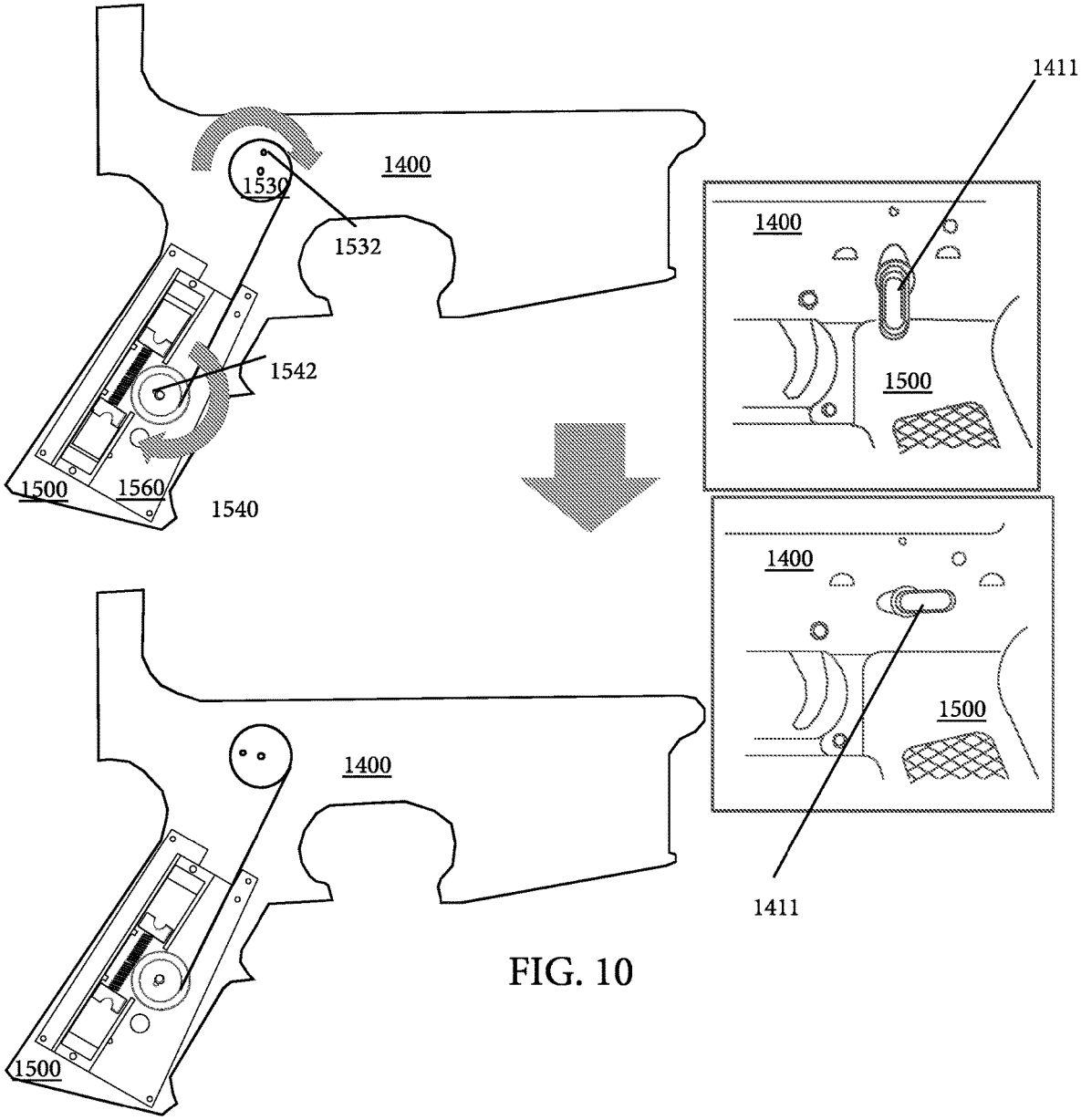
FIG. 10 is a schematic of mechanical correspondence of movement between the selector drive gear and the pistol grip drive gear 1540.

FIG. 10 is a schematic of mechanical correspondence of movement between the selector drive gear and the pistol grip drive gear 1540. As shown in the top-down diagram, motorized rotation of the drive rod 1551 causes rotation of grip gear 1540 (see, e.g., FIG. 8). The rotation of the grip gear 1540 may correspondingly be transferred to the lever gear 1530 via the gear line 1535. As discussed above and shown in the boxed areas of FIG. 10, rotation of the lever gear 1530 correspondingly causes a change of position of the lever 1411 from a "FIRE" to a "SAFE" position.

Figure 11A:
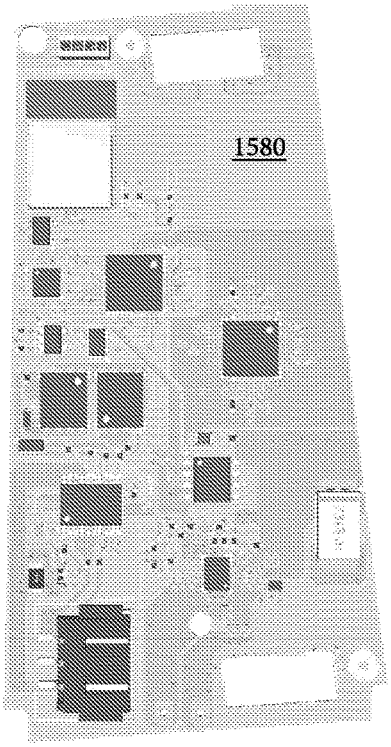
FIG. 11A is a front view of a motherboard 1580.
Figure 13:
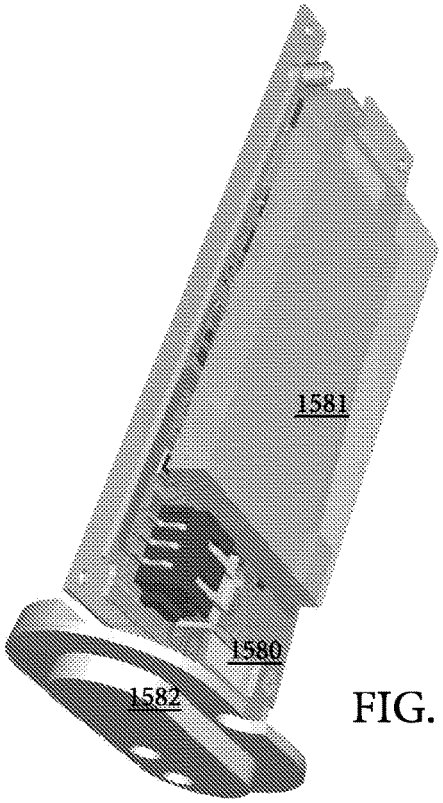
FIG. 13 is a perspective view of an assembly of the motherboard 1580, the batter 1581, and the charging port 1582.
Figure 11B:
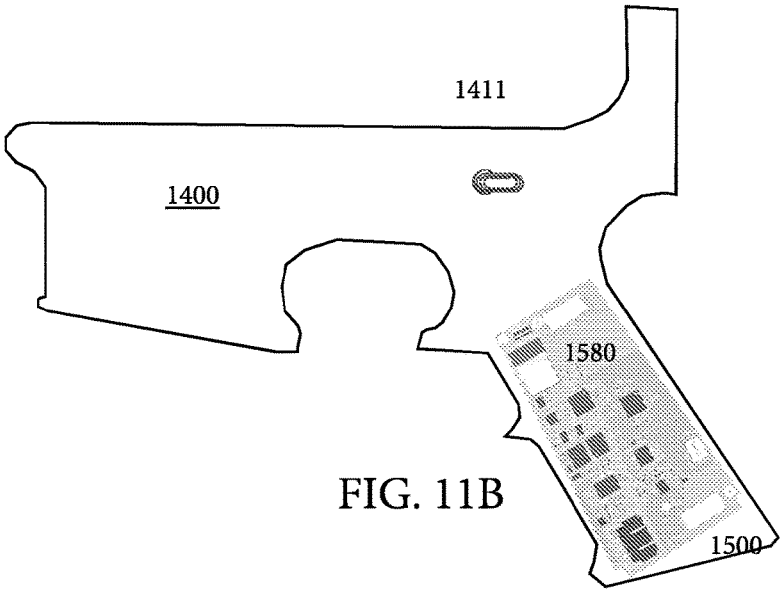
FIG. 11B is a left-side diagram of the motherboard 1580 and control lever 1411 overlade on a silhouette of the lower receiver 1400 and pistol grip 1500 of a firearm 1000.
Figure 12A:
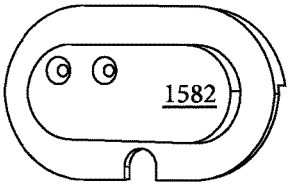
FIG. 12A is a front oriented perspective of a charging port 1582 that defines the butt of a pistol grip 1500 (not shown)
Figure 12B:
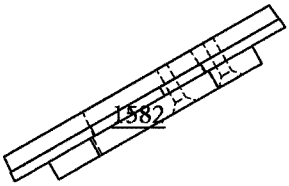
FIG. 12B is a side view of a charging port 1582 that defines the butt of a pistol grip.

As alluded to above, the drive system may be remotely controlled. FIG. 11A is a front view of a motherboard 1580. Suitably, the mother board features a radio frequency or other receiver that may be operated to receive signals that initiate the motors 1570 (not shown) to turn the lever 1411 (not shown) as described above. Suitably, the mother board may be disposed on the backside of the grip plate 1560 (FIG. 9A) and electrical wiring passed from the mother board to the motor 1570 via the electrical pathway 1561 (FIG. 9A). Suitably, the motherboard 1580 has a power source (e.g., battery 1581). FIG. 11B is a left-side diagram of the motherboard 1580 and control lever 1411 overlade on a silhouette of the lower receiver 1400 and pistol grip 1500 of a firearm 1000. FIG. 12A is a front oriented perspective of a charging port 1582 that defines the butt of a pistol grip 1500 (not shown). FIG. 12B is a side view of a charging port 1582 that defines the butt of a pistol grip. The charging port 1582 may be used to provide electric charge to the battery 1581. FIG. 13 is a perspective view of an assembly of the motherboard 1580, the battery 1581, and the charging port 1582.

Figure 14A:
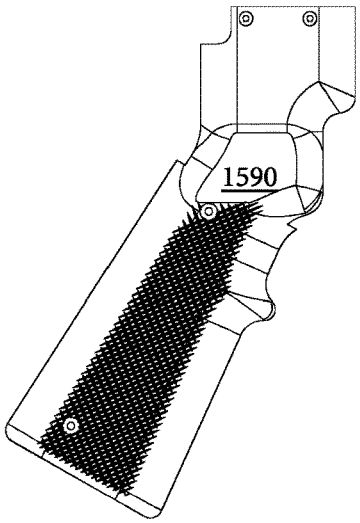
FIG. 14A is a front view of a right-side pistol grip case 1590.
Figure 14B:
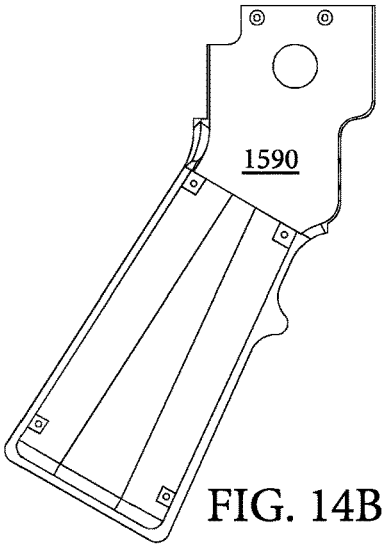
FIG. 14B is a back view of a right-side pistol grip case 1590.
Figure 14C:
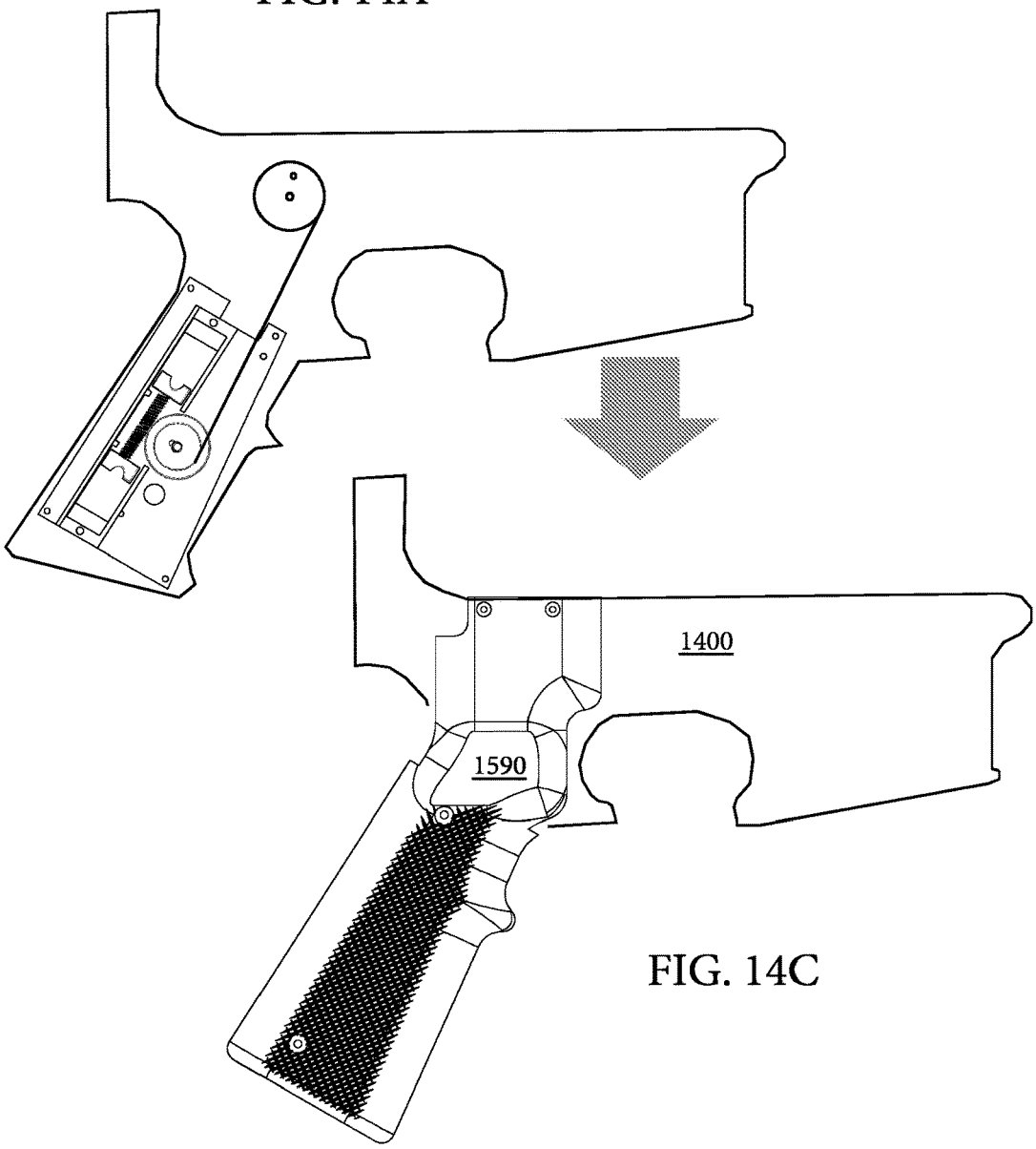
FIG. 14C is a diagram of installation of the right side pistol grip case 1590 over the lower receiver 1400, selector drive gear 1530, and pistol grip plate 1560.

In a preferred embodiment, the drive system and lever gear 1530 may be kept in the pistol grip 1500. FIG. 14A is a front view of a right-side pistol grip case 1590. FIG. 14B is a back view of a right-side pistol grip case 1590. FIG. 14C is a diagram of installation of the right side pistol grip case 1590 over the lower receiver 1400, selector drive gear 1530, and pistol grip plate 1560.

Figure 15A:
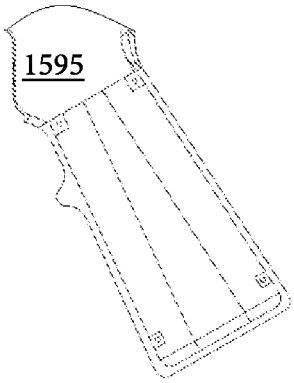
FIG. 15A is a front view of a left-side pistol grip case 1595.
Figure 15B:
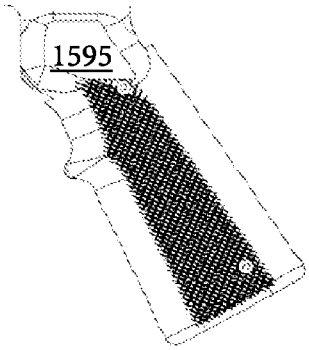
FIG. 15B is a back view of a left-side pistol grip case 1595.
Figure 15C:
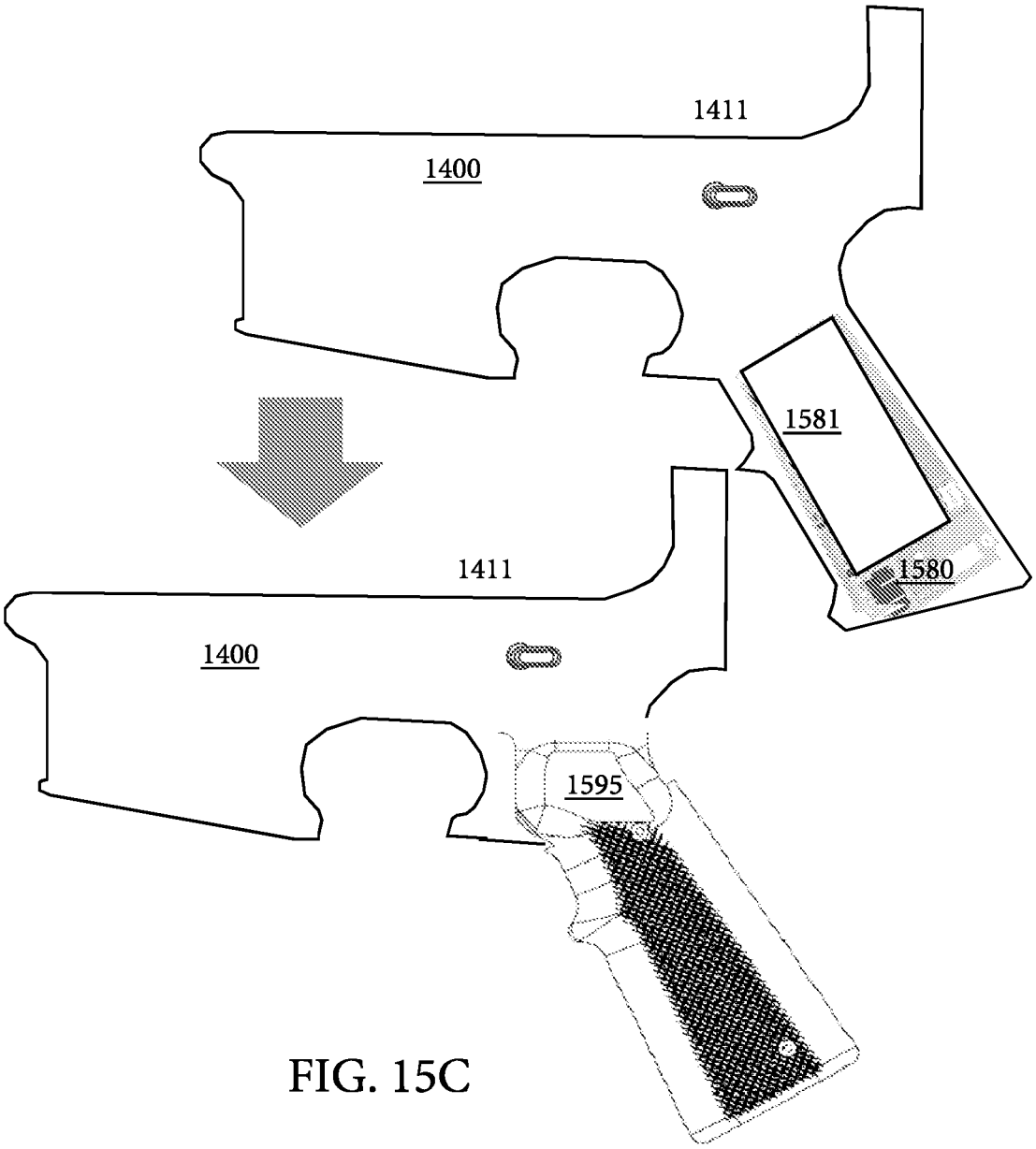
FIG. 15C is a diagram of installation of the right side pistol grip case 1595 over the lower receiver 1400, mother board 1580, and battery 1581.

In the preferred embodiment, the motherboard 1580 and batter 1581 may be kept in the pistol grip 1500. FIG. 15A is a front view of a left-side pistol grip case 1595. FIG. 15B is a back view of a left-side pistol grip case 1595. FIG. 15C is a diagram of installation of the right side pistol grip case 1595 over the lower receiver 1400, mother board 1580, and battery 1581.

Figure 16:
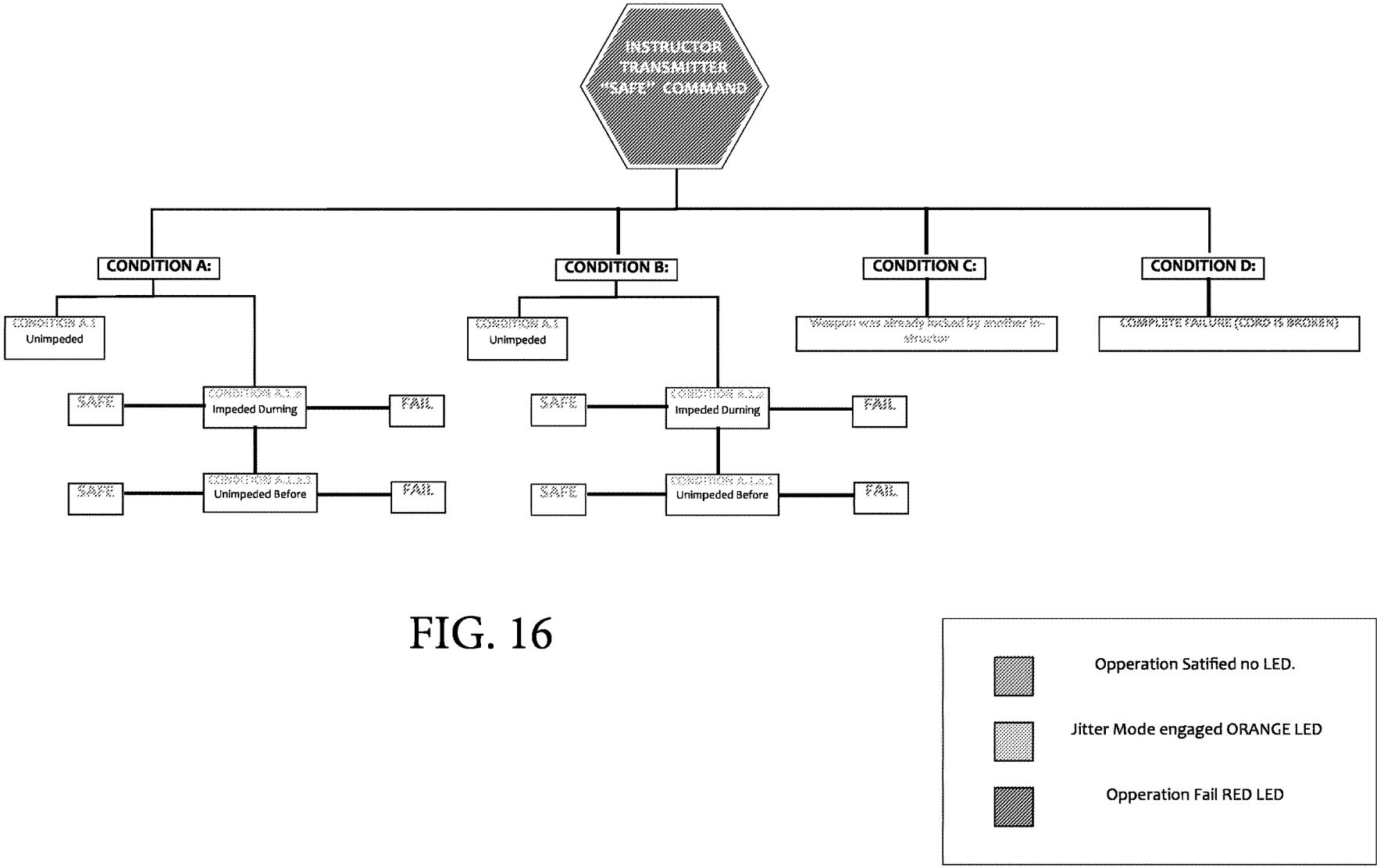
FIG. 16 is a logic flow diagram of control.

As alluded to above, the remote control system may be mounted on a fire arm and used in a live fire exercise. FIG. 16 is a flow chart.

Figure 17:
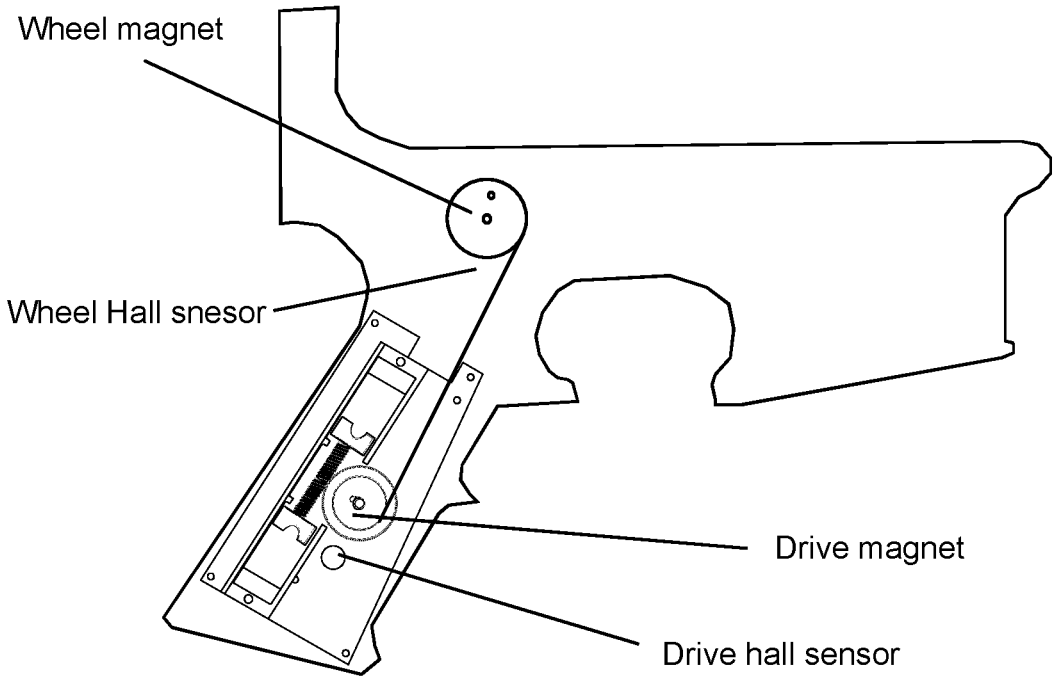
FIG. 17 is a schematic of a pistol grip.

Instructor Transmitter "Safe" Command:

The following four conditions are based on the various situations that the Wheel and Drive Hall Sensors (and combinations of the two) might be in when a "SAFE" command is received from an instructor transmitter. The resulting motor activity is based on making sure that after the command is received, the weapon cannot be fired. (SEE FIG. 17 Re: diagram of HALL SENSOR/MAGNET LOCATIONS)

Condition A:

A shooter/student is firing the weapon

Wheel Hall Sensor shows no magnetic presence.

Drive Hall Sensor shows a magnetic presence.

Motors need to run in direction one. Motors will run until the Wheel Hall Sensor shows a magnetic presence.

Once the Wheel Hall Sensor shows a magnetic presence, and the Drive Hall Sensor does not, (After receiving the INSTRUCTOR command "SAFE" and the motors ran in direction one) the weapons selector lever is locked in the "SAFE" position, and cannot be fired.

Condition B:

A shooter/student is not firing the weapon, but they still can

Wheel Hall Sensor shows a magnetic presence.

Drive Hall Sensor shows a magnetic presence.

Motors need to run in direction one. Motors will run until the trip current is reached, and Wheel Hall Sensor STILL shows a magnetic prsence.

Wheel Hall Sensor shows a magnetic presence, and the Drive Hall Sensor does not, (After receiving the INSTRUCTOR command "SAFE" and the motors ran in direction one) the weapons selector lever is locked in the "SAFE" position, and cannot be fired.

Condition C:

Weapon was already locked by another instructor

Wheel Hall Sensor shows a magnetic presence.

Drive Hal Sensor shows a magnetic presence.

Motors do not need to run. This can only occur if another instructor has already sent the lock command, and the unit has already executed the command.

Condition D:

COMPLETE FAILURE (CORD IS BROKEN)

Wheel Hall Sensor shows no magnetic presence.

Drive Hall Sensor shows no magnetic presence.

Motors do not need to run. Transceiver needs to send a complete failure alarm. This condition can only happen if the drive cord is broken.

Did the Motor Drive Execute Direction One Without Problems?

The following, second level conditions are based on the motors activity in response to the "Instructor Transmitter "SAFE" Command from the previously described first level conditions. (TIME PERIOD, CURRENT LEVEL, JITTER MODE DEFINED IN APPENDIX B)

Condition A.1:

Motors need to run in direction one. Motors will run until the Wheel Hall Sensor shows a magnetic presence.

Motors were able to run in direction one for TIME PERIOD ONE.

Motors were able to run in direction one at CURRENT LEVEL ONE.

Motors were able to run in direction one, for the correct time at the correct current, and ended with the Wheel Hall Sensor showing a magnetic presence. This means that the operation was completed successfully and the weapons selector lever is locked in the "SAFE" position and cannot be fired.

Condition A.1.a:

Motors need to run in direction one. Motors will run until the Wheel Hall Sensor shows a magnetic presence.

Motors are able to run for a period of time, but were not able to run for the complete TIME PERIOD ONE Motors are able to run at CURRENT LEVEL ONE for a period of time, but reached stall current before the Wheel Hall Sensor showed a magnetic presence.

Motors were able to run but were stopped before the Wheel Hall Sensor showed a magnetic presence; this means that the shooter (or possibly a malfunction?) interrupted the device.

Motors execute "JITTER MODE"

As long as "JITTER MODE" is active the Handle LED is ON

If "JITTER MODE" is able to finish (Wheel Hall Sensor shows a magnetic presence) Handle LED turns off.

If "JITTER MODE" times out, Handle LED remains on for 30 seconds.

Condition A.1.a.i:

Motors need to run in direction one. Motors will run until the Wheel Hall

Sensor shows a magnetic presence.

Motors were stopped before they were able to run AT ALL

Motor current rose to stall current level IMMEDIATELY.

Motors were not able to run at all, this means that the weapons hammer was forward and the weapons selector lever CANNOT be moved into the "SAFE" position until the weapon is charged.

Motors will execute "JITTER MODE"

As long as "JITTER MODE" is active the Handle LED is ON

If "JITTER MODE" is able to finish (Wheel Hall Sensor shows a magnetic presence) Handle LED turns off.

If "JITTER MODE" times out, Handle LED remains on for 30 seconds.

Condition B.1:

Motors need to run in direction one. Motors will run until the Wheel Hall Sensor shows a magnetic presence.

Motors were able to run in direction one for TIME PERIOD ONE.

Motors were able to run in direction one at CURRENT LEVEL ONE.

Motors were able to run in direction one, for the correct time at the correct current, and ended with the Wheel Hall Sensor showing a magnetic presence. This means that the operation was completed successfully and the weapons selector lever is locked in the "SAFE" position and cannot be fired.

Condition B.1.a:

Motors need to run in direction one. Motors will run until the Wheel Hall Sensor shows a magnetic presence.

Motors are able to run for a period of time, but were not able to run for the complete TIME PERIOD ONE Motors are able to run at CURRENT LEVEL ONE for a period of time, but reached stall current before the Wheel Hall Sensor showed a magnetic presence.

Motors were able to run but were stopped before the Wheel Hall Sensor showed a magnetic presence; this means that the shooter (or possibly a malfunction?) interrupted the device.

Motors execute "JITTER MODE"

As long as "JITTER MODE" is active the Handle LED is ON

Condition B.1.a.i:

Motors need to run in direction one. Motors will run until the Wheel Hall Sensor shows a magnetic presence.

Motors were stopped before they were able to run AT ALL

Motor current rose to stall current level IMMEDIATELY.

Motors were not able to run at all, this means that the weapons hammer was forward and the weapons selector lever CANNOT be moved into the "SAFE" position until the weapon is charged.

Motors will execute "JITTER MODE"

As long as "JITTER MODE" is active the Handle LED is ON

If "JITTER MODE" is able to finish (Wheel Hall Sensor shows a magnetic presence) Handle LED turns off.

If "JITTER MODE" times out, Handle LED remains on for 30 seconds.

"Jitter Mode"

If the motors reach stall/trip current (4.2 amps was our most recent attempt) during an operation in direction one, then the motor drive attempts to run in a rapid deteriorating succession (5 attempts per second for the first 5 seconds) then down to (1 attempt per second for the next 5 seconds). If at any point the attempt runs unimpeded the motors run in direction one until the Wheel Hall Sensor shows a magnetic presence.

Time Period One (We Don't Know Exactly How Long This is)

Motor run time when running in direction one the complete distance to the point the Wheel Hall Sensor shows a magnetic presence, without being impeded at any point.

This measurement is used in conjunction with the motor run current to initiate "JITTER MODE"

If the current does not rise to stall/trip level and the motor run time exceeds the time period one run time (by a safely large margin) this means that the drive cord is broken and represents a complete failure.

Current Level One (We Don't Know Exactly What This is)

The motors running unimpeded.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A method of remotely controlling a safety catch or fire-mode selector for disablement of one or more firearms at live fire-ranges, said method comprising the steps of:

providing a control rod of a safety selector lever through a control rod receiver of a lower receiver of a firearm so that a distal end of the control rod is accessible from one side of the lower receiver and a control lever is located on another side of the lower receiver, wherein the control rod is rotatable relative to the lower receiver to move the control lever from a fire position to a cease-fire position;

securing a selector drive gear to the distal end so that the selector drive gear is rotatable relative to the lower receiver and so that rotating the selector drive gear relative to the lower receiver causes the control rod to rotate relative to the lower receiver to move the control lever from the fire position to the cease-fire position;

providing a pistol grip drive gear to a pistol grip so that the pistol grip drive gear is rotatable relative to the pistol grip;

connecting the pistol grip drive gear to the selector drive gear so that rotating the pistol grip drive gear causes the selector drive gear to rotate;

providing a motor to the pistol grip so that operating the motor rotates the pistol grip drive gear relative to the pistol grip; and, remotely operating the motor so that the pistol grip drive gear rotates relative to the pistol grip, the selector drive gear rotates relative to the lower receiver, and the control rod rotates relative to the lower receiver to move the control lever from the fire position to the cease-fire position.

2. The method of claim 1 wherein the distal end features a nub that extends from said one side of the lower receiver.

3. The method of claim 2 wherein the step of "securing a selector drive gear to the distal end so that the selector drive gear is rotatable relative to the lower receiver and so that rotating the selector drive gear relative to the lower receiver causes the control rod to rotate relative to the lower receiver to move the control lever from the fire position to the cease-fire position" involves securing the selector drive gear to the nub.

4. A method of constructing a remotely controlled a fire-mode selector, said method comprising the step of:

providing a control rod of a safety selector lever through a control rod receiver of a lower receiver of a firearm so that a distal end of the control rod is accessible from one side of the lower receiver and a control lever is located on another side of the lower receiver, wherein the control rod is rotatable relative to the lower receiver to move the control lever from a fire position to a cease-fire position; and, securing a selector drive gear to the distal end so that the selector drive gear is rotatable relative to the lower receiver and so that rotating the selector drive gear relative to the lower receiver causes the control rod to rotate relative to the lower receiver to move the control lever from the fire position to the cease-fire position.

5. The method of claim 4 further comprising the step of:

installing a pistol grip in the lower receiver; and, providing a pistol grip drive gear to the pistol grip so that the pistol grip drive gear is rotatable relative to the pistol grip.

6. The method of claim 5 further comprising the step of:

connecting the pistol grip drive gear to the selector drive gear so that rotating the pistol grip drive gear causes the selector drive gear to rotate.

7. The method of claim 6 further comprising the step of:

Installing a motor within the pistol grip so that operating the motor rotates the pistol grip drive gear relative to the pistol grip.

* * * * *